US010340098B2

(12) United States Patent
Pan et al.

(10) Patent No.: US 10,340,098 B2
(45) Date of Patent: Jul. 2, 2019

(54) KEY STRUCTURE

(71) Applicant: Primax Electronics Ltd., Taipei (TW)

(72) Inventors: Ding-Hsiang Pan, Taipei (TW); Chin-Sung Pan, Taipei (TW); Ying-Te Chiang, Taipei (TW); Kun-I Yuan, Taipei (TW)

(73) Assignee: PRIMAX ELECTRONICS LTD, Taipei (TW)

( * ) Notice: Subject to any disclaimer, the term of this patent is extended or adjusted under 35 U.S.C. 154(b) by 0 days.

(21) Appl. No.: 15/906,812

(22) Filed: Feb. 27, 2018

(65) Prior Publication Data

US 2019/0122835 A1 Apr. 25, 2019

(30) Foreign Application Priority Data

Oct. 20, 2017 (TW) ..... 106136199 A

(51) Int. Cl.
*H01H 3/12* (2006.01)
*H01H 13/02* (2006.01)

(52) U.S. Cl.
CPC ..... *H01H 13/023* (2013.01); *H01H 3/125* (2013.01); *H01H 2219/036* (2013.01); *H01H 2219/058* (2013.01); *H01H 2219/06* (2013.01)

(58) Field of Classification Search
CPC ..... H01H 13/023; H01H 3/125; H01H 2219/036; H01H 2219/058; H01H 2219/06
USPC ..... 200/293
See application file for complete search history.

(56) References Cited

U.S. PATENT DOCUMENTS 9,214,300 B2 * 12/2015 Chen ..... H01H 13/83
2009/0283393 A1 * 11/2009 Chen ..... G06F 3/0202 200/314
2010/0128427 A1 * 5/2010 Iso ..... G06F 1/1616 361/679.09

* cited by examiner

*Primary Examiner* — Anthony R Jimenez
(74) *Attorney, Agent, or Firm* — Kirton McConkie; Evan R. Witt

(57) ABSTRACT

A key structure, including a keycap, a movable mechanism, a support plate, a circuit board, and an indicator light-emitting element. The support plate and the movable mechanism pivotally connected to the support plate are disposed above the circuit board. The circuit board has a groove, and the indicator light-emitting element is embedded in the groove and is aligned with the keycap. The indicator light-emitting element emits light upward. The light may be directly emitted into the movable mechanism and is subsequently emitted outward through a light hole of the keycap.

5 Claims, 3 Drawing Sheets

KEY STRUCTURE

FIELD OF THE INVENTION

This application provides a key structure, and in particular, to a key structure having an indicator light.

BACKGROUND OF THE INVENTION

A keyboard is an indispensable device when people use a computer nowadays. A user presses a plurality of keys provided on the keyboard to input instructions. Referring to FIG. 1, FIG. 1 is a schematic sectional view of a conventional function key. In most cases, the keyboard has a function key 9. The function key 9 here is, for example, a Caps-Lock key, and an indicator light 91 is provided below the function key 9. Light of the indicator light 91 passes through a keycap 90 of the function key 9 to remind a user of a current state of the function key 9. Further, the indicator light 91 is turned on when the function key 9 is pressed for the first time, and the indicator light 91 stays on after the function key 9 is released to remind the user that the function key 9 is currently in a first state. When the function key 9 is pressed again, the indicator light 91 is turned off to remind the user that the function key 9 is currently in a second state.

Specifically, the keycap 90 of the function key 9 has a light hole 905, so that the light of the indicator light 91 located below the function key 9 is emitted upward to pass through the light hole 905. However, in a current architecture of the function key 9, to prevent a structure of the function key 9 from blocking the light of the indicator light 91 from upward radiation, the function key 9 needs to be made wider to provide space in the transverse direction. That is, below the keycap 90, the space on one side (for example, the left side) is occupied by a key mechanism 92. The space on the other side (for example, the right side) needs to be reserved for the light of the indicator light 91 to pass through, and as a result no element can be disposed here. That is, it needs to be avoided to arrange the indicator light 91 right below the key mechanism 92. Therefore, the function key 9 occupies a relatively large transverse area and consequently affects the arrangement of all keys of the keyboard. In view of the above, the conventional function key 9 still needs to be improved.

SUMMARY OF THE INVENTION

A main objective of the present invention is to provide a key structure. Light may pass through a movable mechanism of the key structure. That is, light emitted by an indicator light-emitting element located right below the movable mechanism may directly pass through the movable mechanism and is emitted upward through a keycap. Therefore, in the key structure, space does not need to be additionally provided on a side for use as a light channel for the light to pass through.

Another objective of the present invention is to provide a key structure. A circuit board of the key structure has a groove. The indicator light-emitting element is electrically connected to the circuit board and is embedded in the groove. When the key structure is completely pressed, the movable mechanism does not interfere with the indicator light-emitting element.

A preferred implementation concept of this application is to provide a key structure, including:

a keycap, having a light hole;

a movable mechanism, disposed below the keycap, where the movable mechanism has an upper connection end and a lower connection end that are opposite to each other, and the upper connection portion is pivotally connected to the keycap;

a support plate, disposed below the keycap, where the lower connection end of the movable mechanism is pivotally connected to the support plate, and the support plate has a central opening;

a circuit board, disposed below the support plate, where the circuit board has at least one groove, and the groove is correspondingly located right below the keycap;

at least one trigger switch element, disposed on the circuit board, where one end portion of the trigger switch element is electrically connected to the circuit board, and the other end portion of the trigger switch element penetrates the central opening of the support plate to be abutted against the keycap; and at least one indicator light-emitting element, electrically connected to the circuit board and embedded in the groove, where light emitted by the indicator light-emitting element sequentially travels upward through the central opening of the support plate, the movable mechanism, and the light hole of the keycap and is emitted outward.

In a preferred embodiment, the movable mechanism is a scissor mechanism, and the scissor mechanism is made of a transparent material, so that the light emitted by the indicator light-emitting element passes through the scissor mechanism.

In a preferred embodiment, the movable mechanism is a scissor mechanism, and the scissor mechanism has a through hole, so that the light emitted by the indicator light-emitting element passes through the through hole of the scissor mechanism.

In a preferred embodiment, a part of the groove is shielded by a light shielding portion of the support plate, and another part of the groove is shielded by the movable mechanism, so that the light emitted by the indicator light-emitting element is reflected by the light shielding portion of the support plate, then passes through the scissor mechanism and the light hole of the keycap, and is emitted outward.

In a preferred embodiment, the groove is located right below the movable mechanism, the indicator light-emitting element located in the groove does not protrude from an upper surface of the circuit board, and when the key structure is completely pressed, the movable mechanism does not interfere with the indicator light-emitting element.

DETAILED DESCRIPTION OF THE PREFERRED EMBODIMENT

Figure 1:
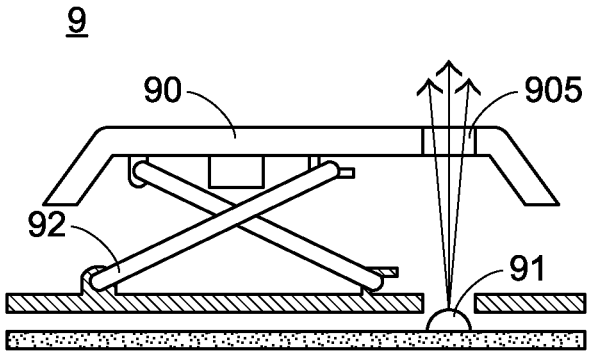
FIG. 1 is a schematic sectional view of a conventional function key.
Figure 2:
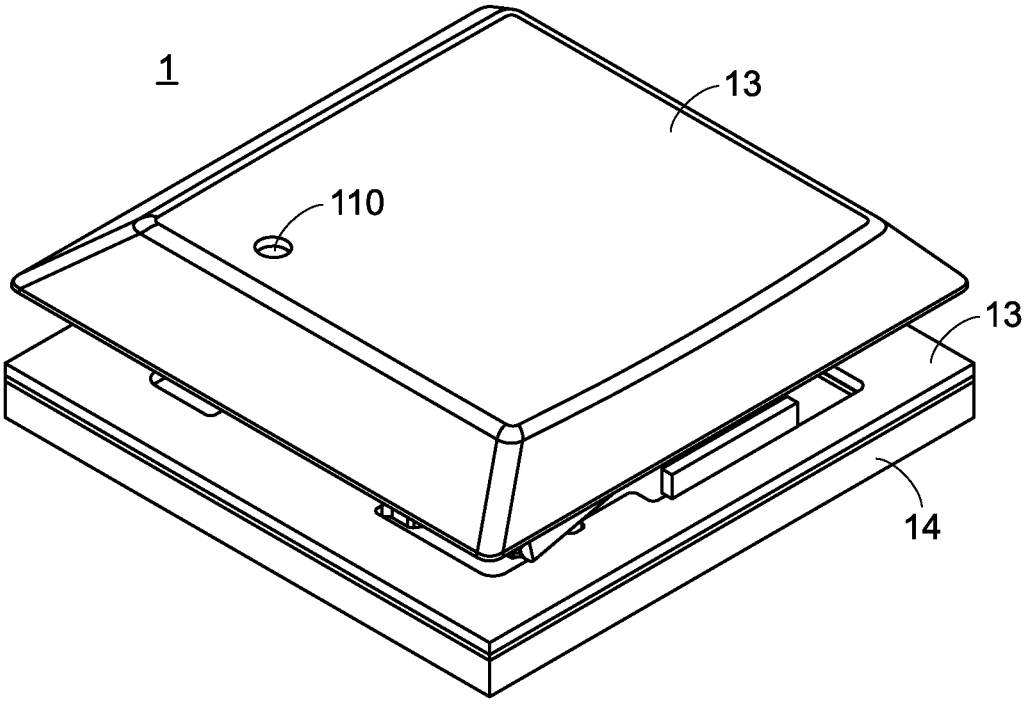
FIG. 2 is a three-dimensional schematic view of a key structure according to this application.
Figure 3:
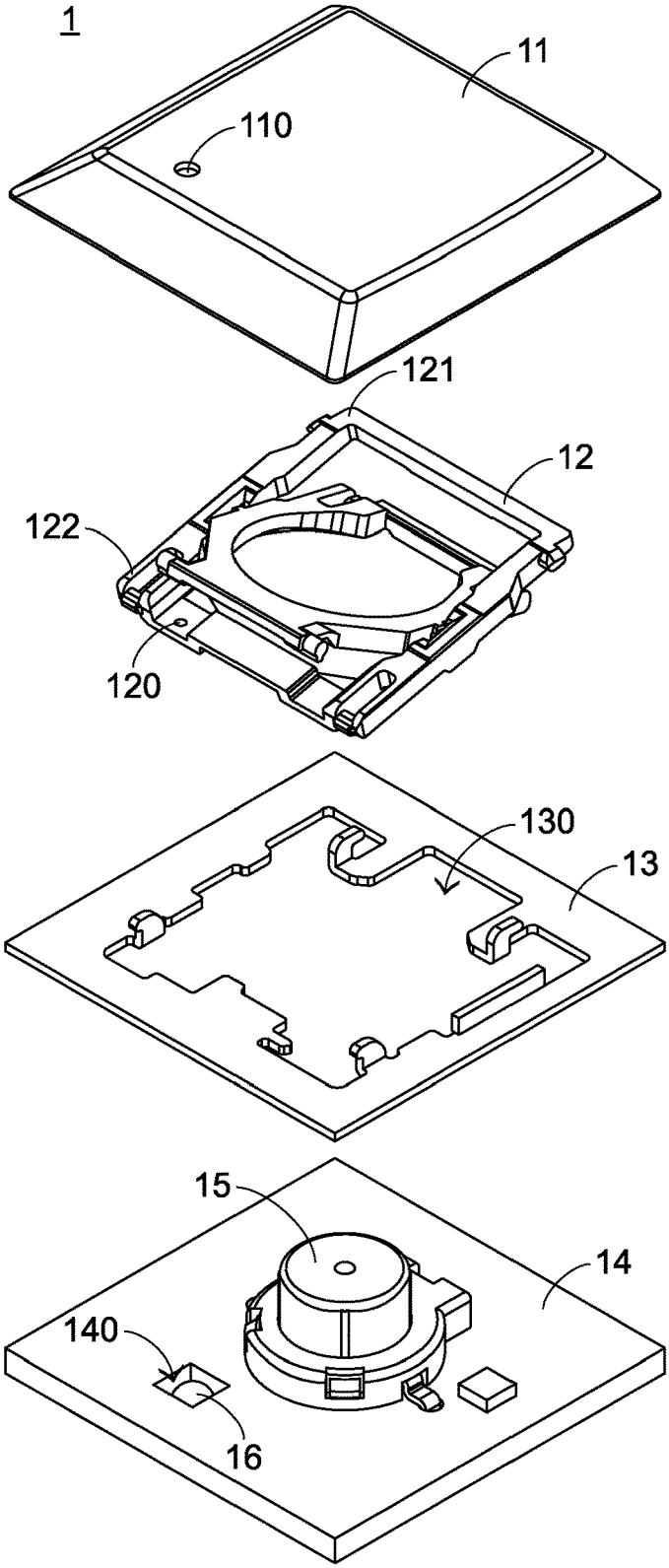
FIG. 3 is a schematic exploded view of a key structure according to this application.
Figure 4:
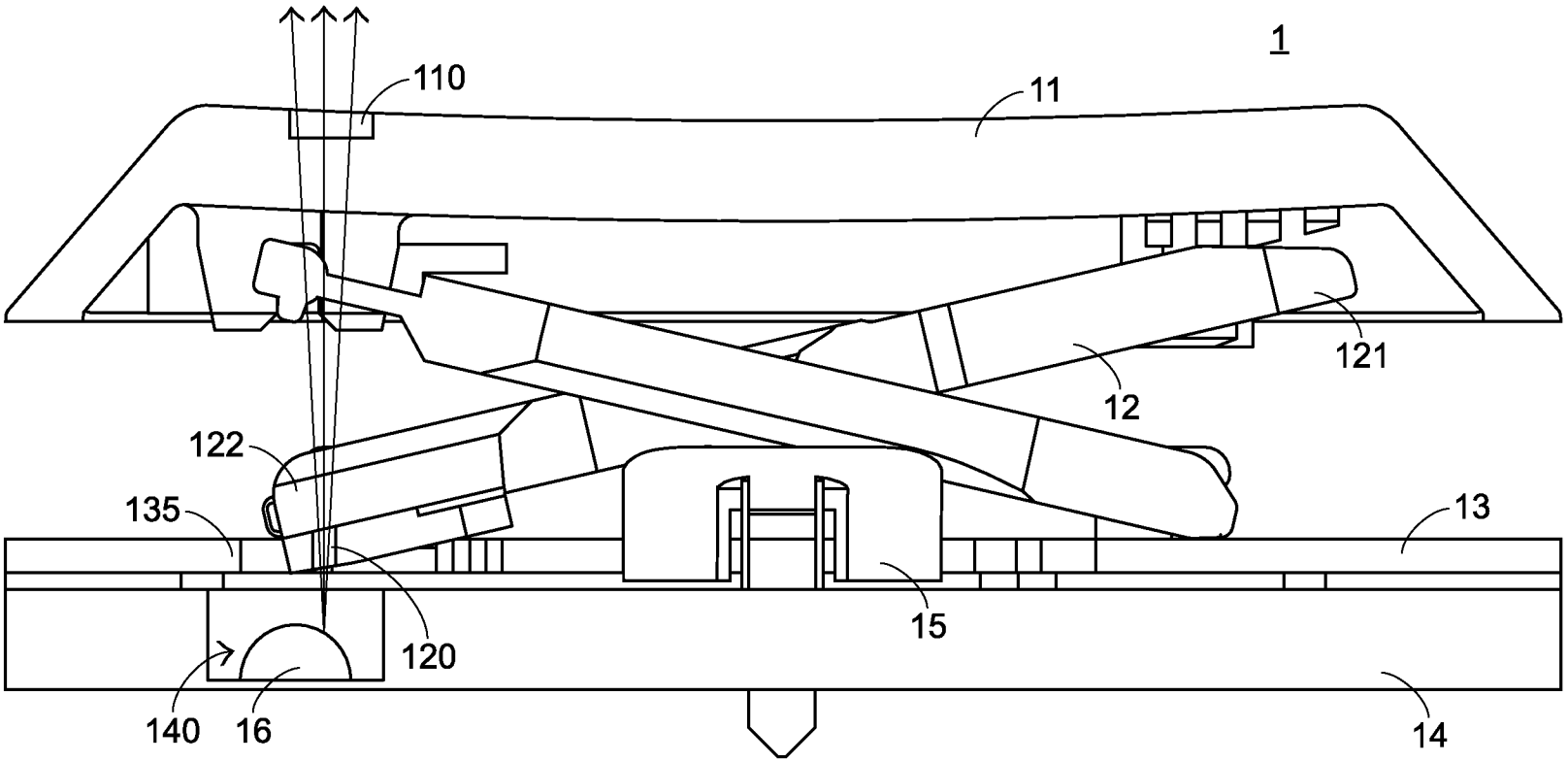
FIG. 4 is a schematic sectional view of a key structure according to this application.

Referring to FIG. 2 to FIG. 4, FIG. 2 is a three-dimensional schematic view of a key structure according to this application, FIG. 3 is a schematic exploded view of a key structure according to this application, and FIG. 4 is a schematic sectional view of a key structure according to this application. A key structure 1 in this application may be applied to a keyboard (not shown in the figure), but this application is not limited thereto. The key structure 1 of this application includes a keycap 11, a movable mechanism 12, a support plate 13, a circuit board 14, a trigger switch element 15, and an indicator light-emitting element 16. The keycap 11 is used to be pressed by a user, and therefore is located at the top of the entire key structure 1. Moreover, the movable mechanism 12 is located between the keycap 11 and the support plate 13. The movable mechanism 12 has an upper connection end 121 and a lower connection end 122 that are opposite to each other. The upper connection end 121 is pivotally connected to the keycap 11, and the lower connection end 122 is pivotally connected to the support plate 13. The circuit board 14 is disposed below the support plate 13, so as to receive downward movement of the keycap 11 to generate an input signal.

Specifically, the trigger switch element 15 and the indicator light-emitting element 16 are disposed on the circuit board 14. One end portion of the trigger switch element 15 is electrically connected to the circuit board 14, and the other end portion of the trigger switch element 15 passes through a central opening 130 of the support plate 13 to be abutted against the keycap 11. Therefore, when the keycap 11 is pressed downward towards the circuit board 14 by a user, the trigger switch element 15 may be triggered, and the input signal is generated, so that a system connected to the keyboard is operated and controlled. In addition, it can be known with reference to the foregoing description of elements that the key structure 1 in this application is a mechanical key.

Further, the circuit board 14 has a groove 140, and the groove 140 is correspondingly located right below the keycap 11. The groove 140 is designed to accommodate the indicator light-emitting element 16. The indicator light-emitting element 16 is embedded in the groove 140 and is electrically connected to the circuit board 14. In a preferred embodiment, the indicator light-emitting element 16 located in the groove 140 does not exceed an upper surface of the circuit board 14. In this way, although the indicator light-emitting element 16 in this application is disposed right below the movable mechanism 12, even if the key structure 1 is completely pressed, the movable mechanism 12 at most may be pressed to the upper surface of the circuit board 14 and does not interfere with the indicator light-emitting element 16 located in the groove 140. With such an arrangement, movement of the movable mechanism 12 is not restricted by the indicator light-emitting element 16.

In addition, the keycap 11 has a light hole 110. When light of the indicator light-emitting element 16 located in the groove 140 is emitted upward, the light may be emitted outward through the light hole 110 of the keycap 11. Therefore, the user may observe whether the indicator light-emitting element 16 emits light to determine a current state of the key structure 1. A sequential travel path of the light is: The light is emitted from the indicator light-emitting element 16, passes through the central opening 130 of the support plate 13, the movable mechanism 12, and the light hole 110 of the keycap 11, and is emitted outward.

By way of example but not limitation, the movable mechanism 12 is a scissor mechanism. The scissor mechanism usually consists of two frame bodies that are connected to and intersect each other, and the two frame bodies occupy most of the space. To make the light pass through the scissor mechanism, the following two implementation aspects are developed in this application.

In a first implementation aspect, the scissor mechanism is made of a transparent material, and a transparency coefficient of the transparent material is preferably higher. Therefore, the light emitted by the indicator light-emitting element 16 passes through the central opening 130 of the support plate 13, then enters and passes through the scissor mechanism, and is emitted outward through the light hole 110 of the keycap 11.

In a second implementation aspect, the scissor mechanism has a through hole 120, so that the light emitted by the indicator light-emitting element 16 passes through the central opening 130 of the support plate 13, then enters the through hole 120 of the scissor mechanism, and is emitted outward through the light hole 110 of the keycap 11. It should be noted that the first implementation aspect and the second implementation aspect can be implemented together. Details are no longer described.

In addition, the support plate 13 is made of an opaque material and thus has a light shielding function. Similarly, the groove 140 of the circuit board 14 has a function of restricting a light-emitting range. Therefore, in the design of this application, a light shielding portion 135 (referring to FIG. 4) is formed at the support plate 13. The light shielding portion 135 extends along a horizontal direction parallel to the circuit board 14, to shield a part of an opening of the groove 140, so as to restrict a diffusion angle of the indicator light-emitting element. Another part of the opening of the groove 140 is shielded by the movable mechanism 12. However, because the foregoing movable mechanism 12 is designed to allow the light to pass through, the part of the light emitted by the indicator light-emitting element 16 is reflected by the light shielding portion 135 of the support plate 13, is emitted upward again and passes through the movable mechanism 12 and the light hole 110 of the keycap 11, and is emitted outward. Therefore, light dissipation can be avoided, so that concentration and utilization of light can be improved.

It should be noted that the light shielding portion 135 of the support plate 13 can be changed to an aspect of extending upward along a vertical direction, so as to shield lights from a side of the groove 140 to prevent light leakage. This is also a feasible implementation structure.

In conclusion, the indicator light-emitting element of the key structure of this application is completely embedded in the circuit board. When the key structure is completely pressed, the movable mechanism at most may be pressed to the upper surface of the circuit board and does not interfere with the indicator light-emitting element. In addition, the movable mechanism of this application is made of a transparent material or has a through hole for light to pass through. Therefore, space can be saved, thereby facilitating the arrangement of all keys of the keyboard.

The foregoing embodiments only exemplarily describe the principle and effects of the present invention and the technical features of the present invention, and are not intended to limit the protection scope of the present invention. A change or equivalent arrangement that can be easily accomplished by a person skilled in the art without departing from the technical principle and spirit of the present invention falls within the scope claimed in the present invention. Therefore, the claims of the present invention should be as defined by the following claims.

What is claimed is:

1. A key structure, comprising:

a keycap, having a light hole;

a movable mechanism, disposed below the keycap, wherein the movable mechanism has an upper connection end and a lower connection end that are opposite to each other, and the upper connection end is pivotally connected to the keycap, wherein the movable mechanism is a scissor mechanism, and the scissor mechanism has a through hole;

a support plate, disposed below the keycap, wherein the lower connection end of the movable mechanism is pivotally connected to the support plate, and the support plate has a central opening;

a circuit board, disposed below the support plate, wherein the circuit board has at least one groove, and the groove is correspondingly located directly below the keycap;

at least one trigger switch element, disposed on the circuit board, wherein one end portion of the trigger switch element is electrically connected to the circuit board, and an other end portion of the trigger switch element passes through the central opening of the support plate to be abutted against the keycap; and at least one indicator light-emitting element, electrically connected to the circuit board and embedded in the groove, wherein light emitted by the indicator light-emitting element sequentially travels upward through the central opening of the support plate, the through hole of the scissor mechanism, and the light hole of the keycap and is emitted outward.

2. The key structure according to claim 1, wherein a part of the groove is shielded by a light shielding portion of the support plate, and another part of the groove is shielded by the movable mechanism, so that the light emitted by the indicator light-emitting element is reflected by the light shielding portion of the support plate, passes through the scissor mechanism and the light hole of the keycap, and is emitted outward.

3. The key structure according to claim 1, wherein the groove is located directly below the movable mechanism, the indicator light-emitting element located in the groove does not extend above an upper surface of the circuit board, and when the key structure is completely pressed, the movable mechanism does not interfere with the indicator light-emitting element.

4. The key structure according to claim 1, wherein the scissor mechanism is made of a transparent material, so that the light emitted by the indicator light-emitting element passes through the scissor mechanism.

5. The key structure according to claim 4, wherein a part of the groove is shielded by a light shielding portion of the support plate, and another part of the groove is shielded by the movable mechanism, so that the light emitted by the indicator light-emitting element is reflected by the light shielding portion of the support plate, passes through the scissor mechanism and the light hole of the keycap, and is emitted outward.

* * * * *